United States Patent [19]

Long

[11] Patent Number: 4,967,918

[45] Date of Patent: Nov. 6, 1990

[54] DRINKING VESSEL WITH FINGER RECESSES

[76] Inventor: Clyde Long, 3462 Windsor, St-Hubert, (Quebec), Canada, J4T 2Y5

[21] Appl. No.: 411,852

[22] Filed: Sep. 25, 1989

[51] Int. Cl.[5] ..... A47G 19/22; B65D 23/10

[52] U.S. Cl. ..... 215/100 A; 220/94 A

[58] Field of Search ..... 215/100 A, 1 R, 99.5; 220/85 H, 94 A; 229/1.5 H; 224/148; 294/25, 26.5, 144, 172

[56] References Cited

U.S. PATENT DOCUMENTS

| | | | |
|---|---|---|---|
| D. 144,223 | 3/1946 | Stumpf . | |
| D. 160,567 | 10/1950 | Wylie | 220/94 A X |
| D. 278,016 | 3/1985 | Myrbo | 220/94 A X |
| 278,205 | 5/1883 | Weiss | 215/99.5 |
| 1,505,132 | 8/1924 | Delich | 215/99.5 |
| 1,953,723 | 4/1934 | Quante | 215/99.5 |
| 2,142,811 | 1/1939 | Agonis | 65/13 |
| 2,865,384 | 12/1958 | Noon | 215/1 R |
| 2,903,818 | 9/1959 | Humke | 215/99.5 X |
| 3,198,377 | 8/1965 | Buckley | 220/94 A |
| 3,847,295 | 11/1974 | Taylor | 215/1 R |
| 4,073,397 | 2/1978 | Snodgrass | 215/100 A X |
| 4,681,236 | 7/1987 | Ilk | 215/99.5 |
| 4,712,698 | 12/1987 | Greenberg | 215/100 A |
| 4,746,057 | 5/1988 | Wagner | 229/1.5 H |

FOREIGN PATENT DOCUMENTS

| | | | |
|---|---|---|---|
| 491276 | 2/1930 | Fed. Rep. of Germany | 215/99.5 |
| 1205459 | 9/1970 | United Kingdom | 215/99.5 |

*Primary Examiner*—Sue A. Weaver

*Attorney, Agent, or Firm*—Eckert, Seamans, Cherin & Mellott

[57] ABSTRACT

A handheld drinking vessel has finger recesses in its base to augment the users grip on the vessel. The base contains at least one transverse channel passing approximately under the vessel's center of gravity. The channel has an upper surface sized and contoured for the placement of a non-index finger to be in contact with said surface.

2 Claims, 2 Drawing Sheets

FIG. 1
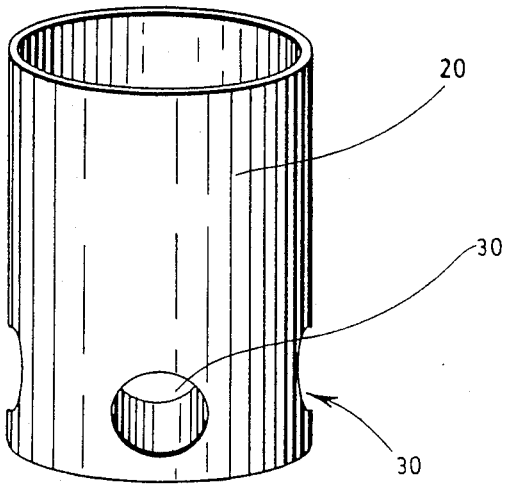
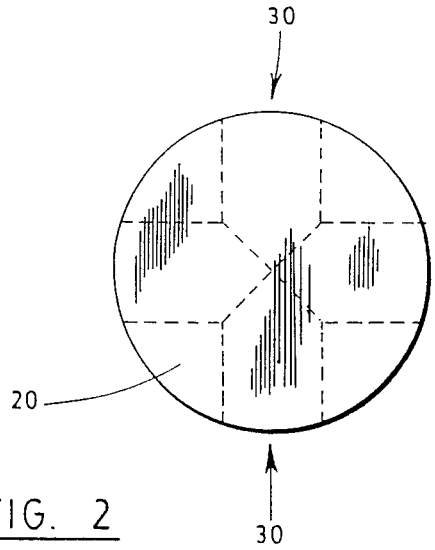
FIG. 2

FIG. 3
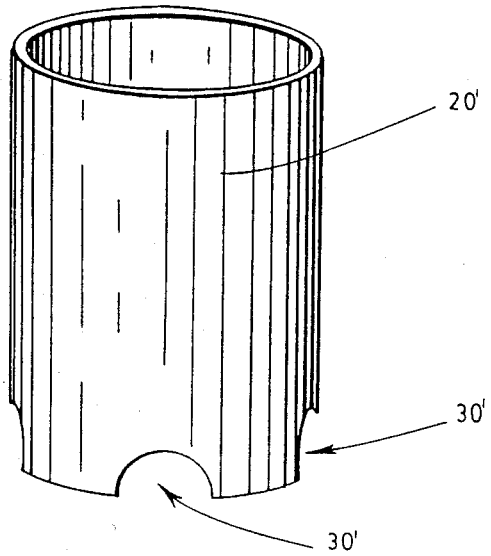
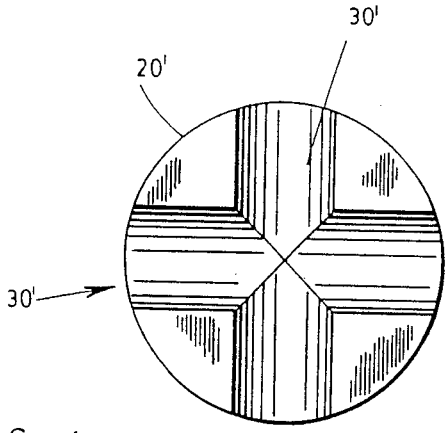
FIG. 4

DRINKING VESSEL WITH FINGER RECESSES

BACKGROUND OF THE INVENTION (i) Field of the Invention:

This invention relates to a handheld drinking vessel having finger recesses in its base to augment the user's grip on the vessel.

(ii) Description of the Prior Art:

U.S. Pat. No. 2,142,811 discloses a drinking glass which can be readily gripped and thus held against slipping as a result of indentations or depressions in the side of the glass for accomodating the user's fingers. Thus, the user of this glass must be able to exert a pinching force between fingers and thumb to benefit from the glass's design.

A similar reliance on this capacity of the human hand is needed for gainful use of the invention disclosed in U.S. Pat. No. 4,712,698 which describes a beaker having concave indentations for three fingers and an opposing thumb.

U.S. Design Pat. No. 144,223 shows a drinking cup whose annular bottom rim is punctuated by four symmetrically disposed arcuate notches.

U.S. Pat. No. 4,681,236 discloses a wine glass having cylindrical holes in its stem for insertion of colored material.

For individuals, particularly children and the elderly, suffering from reduced manual gripping abilities, it is desireable to have a drinking vessel whose design enables the user to support it without needing to clench his hand.

OBJECTS OF THE INVENTION

It is therefore an object of this invention to provide such a drinking vessel.

Another object is to provide such a vessel having finger recesses in its base to receive a finger of the user so that he can exert upward pressure on the glass along the whole length of his finger.

A further object is to provide recesses in the base of such a glass such that part or all of a user's finger may be placed in the recess and that all of the amount inserted be in contact with the glass.

SUMMARY OF THE INVENTION

In meeting these and other objects, the present invention provides a handheld drinking vessel comprising: an open-topped container having a center of gravity and a base containing at least one transverse channel open at at least one end thereof and passing approximately under the center of gravity, the channel having an upper surface sized and contoured for the placement of at least a portion of a non-index finger into said channel such that all of said portion is in contact with said surface.

In one embodiment, the channel is open along a bottom portion thereof for insertion of said finger from below said vessel.

In a second embodiment, the channel is enclosed in said base with at least one open end for lateral insertion of said finger.

Preferably the vessel has two of said channels disposed to the mutually perpendicular.

The invention allows a drinker to support his glass without needing to clench his hand. Therefore, individuals lacking a manual clenching ability are thus enabled to drink.

Manual support is thus provided by the insertion of at least part of the second, third or little finger into one of the channels while the thumb and forefinger (index finger) rest unclenched either side of the container to ensure its verticality in use, which does not require the exertion of lateral pressure by these digits on the side of the vessel.

The objects, advantages and other features of the present invention will become more apparent upon reading of the following non-restrictive description of a preferred embodiment thereof, made within reference to the accompanying drawings.

BRIEF DESCRIPTION OF THE DRAWINGS

In these drawings, which illustrate embodiments of the invention,

FIG. 1 is a perspective view of a first embodiment;

FIG. 2 is a bottom view of this first embodiment;

FIG. 3 is a perspective view of a second embodiment; and

FIG. 4 is a bottom view of this second embodiment.

DETAILED DESCRIPTION OF THE INVENTION

The invention may be any handheld drinking vessel such as a glass, beaker, cup, mug, goblet or tumbler.

It may be made of any material such a glass, wood, ceramic, plastic, porcelain or metal.

The vessel may be of any shape and may have parallel sides, be conical, frusto-conical, may have a stem between base and container may be cross-sectionally square, round or polygonal.

The vessel may have additional indentations or depressions for abetted gripping or for other purposes.

The channel or channels may be of various sizes to accommodate one or more of the three non-index fingers of the user's hand. However, it is preferred that the channel(s) be designed to accommodate the average human little finger.

In FIG. 1, the vessel 20 is cylindrical and has two mutually perpendicular cylindrical transverse through holes 30 forming the finger channels. FIG. 2 shows the position of these channels from below.

FIG. 3 shows a second cylindrical vessel 20' this time with hemispherical channels 30' removed from the bottom of the vessel. Again the channels are mutually perpendicular.

The contours of respective channels may vary but must allow contact between the upper surface of the channel and as much of the finger as is placed under the glass.

However, it is preferred that at least the upper surface of the channel(s) have a continuous and concave contour.

It is not essential for the channels to span the whole breadth of the vessel as long as they are of sufficient length so that at least part of the inserted finger may be positioned below the center of gravity. It is however preferred that the channels be through holes or cavities, i.e. that the channels have two open ends, coterminous with the sides of the vessel's base.

While there have been shown and described what are at present believed to be the preferred embodiments of the invention, it will be obvious to those skilled in the art that various changes and modifications may be made to them without departing from the scope of the invention as defined by the appended claims.

What is claimed is:

1. A handheld drinking vessel, comprising an open-topped container having a center of gravity and a base provided with at least one cylindrical transverse hole open at least at one end thereof and passing approximately under said center of gravity, said hole being sized to allow at least partial insertion therein of a single non-index finger, and having an inner surface so contoured as to be in contact with at least part of said single finger when inserted into said hole;

whereby, in use, at least partial insertion of one of a user's second, third and little finger into said at least one hole provides manual support to said container while the user's thumb and index finger can rest unclenched on either side of the container to ensure its verticality.

2. The vessel according to claim 1, comprising two said holes disposed to be mutually perpendicular and wherein each of said holes is a trough hole having two open ends.

* * * * *